US007703400B2

(12) United States Patent
Möckel

(10) Patent No.: US 7,703,400 B2
(45) Date of Patent: Apr. 27, 2010

(54) TABLE WITH A SWIVELABLE TABLE TOP

(75) Inventor: Rico Möckel, Hildesheim (DE)

(73) Assignee: WINI Büromöbel Georg, Schmidt GmbH & Co. KG, Coppenbrügge (DE)

( * ) Notice: Subject to any disclaimer, the term of this patent is extended or adjusted under 35 U.S.C. 154(b) by 687 days.

(21) Appl. No.: 11/517,228

(22) Filed: Sep. 7, 2006

(65) Prior Publication Data

US 2007/0209559 A1 Sep. 13, 2007

(30) Foreign Application Priority Data

Mar. 8, 2006 (DE) ..... 20 2006 003 762 U

(51) Int. Cl.
*A47B 3/00* (2006.01)

(52) U.S. Cl. ..... 108/115; 108/132; 108/91; 108/7

(58) Field of Classification Search ..... 108/7, 108/91, 92, 115, 132, 133, 1; 248/188.6, 248/166, 434, 439
See application file for complete search history.

(56) References Cited

U.S. PATENT DOCUMENTS 4,196,675 A * 4/1980 Cook ..... 108/6
4,879,954 A * 11/1989 Sawamura et al. ..... 108/6
5,927,214 A * 7/1999 Schwartz et al. ..... 108/128
6,336,414 B1 * 1/2002 Stewart et al. ..... 108/115
6,647,900 B1 * 11/2003 Kopish ..... 108/115
2004/0237854 A1 * 12/2004 Piretti ..... 108/115

FOREIGN PATENT DOCUMENTS

| | | | |
|---|---|---|---|
| CH | 681269 | * | 2/1993 |
| DE | 4230381 | * | 4/1993 |
| WO | WO 03/030683 A1 | | 4/2003 |

* cited by examiner

*Primary Examiner*—Hanh V Tran
(74) *Attorney, Agent, or Firm*—Cohen Pontani Lieberman & Pavane LLP

(57) ABSTRACT

Table with a top which can pivot around a lockable pivot axis characterized in that each of two centrally located table legs is connected at the top end by a mounting assembly to a frame part, which carries the table top. A force-transmitting device is provided in at least one of the frame parts. A handle is connected to the force-transmitting device, and the pivot axis can be released by actuating the handle against the force of at least one spring to allow the table top to pivot.

19 Claims, 6 Drawing Sheets

TABLE WITH A SWIVELABLE TABLE TOP

BACKGROUND OF THE INVENTION

1. Field of the Invention

The invention pertains to a table with a top which can pivot around a lockable pivot axis.

2. Description of the Related Art

Many different forms of tables with tops which can pivot around a pivot axis are known and have proven to give good results. The work surfaces of worktables, for example, can usually be adjusted to different angles, where in most cases the surface is pivoted around an axis which is parallel to one of the long edges. Especially in the case of tables with four legs, the axis is located physically in the vicinity of one of the long edges.

In the field of gastronomy, public events, etc., tables have become known which have two central table legs, which stand on splayed-out base parts. If their bases can be nested into each other, a large number of such tables can be stored in a relatively small amount of space after the tops have been tilted by 90°. A table of this type is described in WO 03/030683 A1. Each of the two legs is connected directly here to the table top by means of its own pivot axis, which is oriented at an angle to the top; the pivoting action must therefore occur independently around each of these axes.

The angled orientation of the pivot axis means not only that the table top pivots from a horizontal to a vertical position, but also that the bases, which extend outward from the legs, turn around their vertical axis. The two bases are therefore rotated toward each other, as a result of which the bases of several tables can be nested together and many tables can be stored in an extremely small amount of space.

The stability and especially also the ease of use of this known table with pivoting top, however, are unsatisfactory because of the independence of the two pivot axes.

SUMMARY OF THE INVENTION

Against this background, the task of the invention is to make available a table of the type indicated above which is extremely stable in design and which is also easy to use.

In the case of a table with a top which can pivot around a lockable pivot axis, this technical problem is solved by a table where each of two centrally located table legs is connected at the top end by means of a mounting assembly to a frame part, which carries the table top. A force-transmitting device is provided in at least one of the frame parts. A handle is connected to the force-transmitting device and the pivot axis can be released by actuating the handle against the force of at least one spring to allow the top to pivot.

The table according to an embodiment of the invention offers a number of advantages. In particular, the table top can be considered an independent assembly, and the legs, especially legs together with a frame which connects the legs to each other, can be considered another independent assembly, which means that the bottom support structure can be used for a wide variety of different tops.

In addition, the frame provides a high degree of stability. In particular, if the frame extends around the periphery, it can also provide the top with high flexural rigidity.

A frame is especially advantageous which is designed as a central trough, which carries the top, and in which the force-transmitting device is located. A trough of this type can be easily made in the form of, for example, an extruded aluminum profile.

The top can be attached to the trough in stable, reliable fashion by means of crossbars or the like, suitably spaced along the trough. The number and the arrangement of these crossbars will depend on, for example, the weight and size of the top.

The trough also offers the advantage that the mechanical components for locking and releasing the pivot axis can be easily provided in the trough and will thus be invisible from the outside. Only the handle, to which the force-transmitting device is connected, remains visible. By actuating the handle against the force of at least one spring, the locking mechanism can be released to allow the table top to pivot around the pivot axis.

It is also possible in particular to design the handle in such a way that only one hand is required to actuate it, so that the other hand remains free to pivot the top.

It is also preferable for the pivot axis to be oriented at an angle, so that, when the table top is pivoted, the legs are also rotated around a vertical axis, with the result that a large number of tables of this type can be stored compactly in a row, with their bases nested together.

It has been found advisable, after the handle is released, for the force of the minimum of one spring to lock the pivot axis automatically in certain predetermined, preferred positions. These preferred positions are, for example, a horizontal position and a vertical position of the table top. In addition, the top can also be set an angle of, for example, 30° and/or at and angle of 45° to make it easier to perform certain kinds of work at such tables.

Although the top could be designed to pivot in continuously variable fashion, in which case it would be locked in place by, for example, clamping jaws, it will usually be preferable to lock the top in reliable, load-bearing fashion by means of a positive connection. A positive-locking connection of this type can bear high loads but usually requires the use of individual, predetermined positions.

A positive-locking connection of this type can be provided by a locking pin, preferably by at least one locking pin permanently mounted in the frame, which can be pulled out of a receptacle forming a permanent part of the leg by means of the force-transmitting device.

A locking function of this type by means of a locking pin is reliable as long as the pull-out direction of the locking pin is parallel to an axis, i.e., to an axis of rotation of the mounting assembly.

The force-transmitting device can be a mechanical linkage. It is preferable, however, that the force-transmitting be a Bowden cable, which is simple but also efficient in use. In particular, it is easy to design Bowden cables with different lengths or amounts of play, which means that the handle can be positioned practically anywhere along the length of the trough or other frame part.

In most cases, the Bowden cable will pass around the handle and can be actuated by shifting and/or pivoting the handle.

It is therefore guaranteed that the wishes and requirements of the user can be optimally fulfilled.

So that the table top and possibly the table legs can be pivoted, either each of two frame parts which are oriented transversely to the plane of the pivot axis is provided at a certain point along its length, usually in the middle, with half of the mounting assembly, or the trough is provided at each end with half of the mounting assembly, where each half-unit has a freely projecting axle pin, the axis of the axle pin being at an angle to a center line of the table, especially in two planes. This guarantees that the mounting assemblies will be attached to the frame parts or to the trough carrying the table top in such a way that heavy loads can be supported in a stable manner.

According to an elaboration of this design, both table legs are each provided at the top end with a second half of the mounting assembly, and each half-unit has a receptacle, in which the axle pin can fit with freedom of rotation.

The design of the mounting assemblies offers the advantage that, during the course of the movement, i.e., during pivoting, the required force always remains the same. At no time does the full weight of the table top have to be supported. In addition, the legs are pivoted synchronously and stably.

The axle pin is preferably supported rotatably in a separate sleeve. By choosing a suitable material for the sleeve, such as a plastic or possibly also a metal, a self-lubricating function can be provided at the same time, and the mounting assembly will provide a high degree of precision.

It is advisable for the two half-units of the mounting assembly to have opposing parallel surfaces, to which the axle pin and its receptacle are perpendicular. The pull-out direction of the locking pin is also preferably perpendicular to these surfaces. This simple geometry of the mounting assembly ensures that the top can be released, pivoted, and relocked in a new position in smooth and efficient fashion.

According to an elaboration of this design, at least one of the opposing surfaces has a ring-shaped, circumferential groove, into which a slide ring fits. The groove is preferably in the half-unit permanently attached to the frame. This make it possible for the opposing surfaces to slide across each other easily, while the rest of these surfaces preferably make no contact with each other at all.

The two halves of the mounting assembly can be connected by providing the axle pin with a central threaded bore for the fastening of an opposing mounting plate attached to the table leg, and an attractive appearance can be achieved by covering the axle pin and its attachment with a cap, which is preferably fastened detachably to the second half-unit, i.e., the half-unit permanently connected to the leg.

If a trough is provided to connect the legs, the top can rest on crossbars permanently connected to the trough, where the crossbars can be positioned at any point along the length of the trough. They can be held in place, for example, by T-blocks, held in grooves, which ensures optimal support of the top.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The table according to the invention is explained in greater detail on the basis of the drawing, which provides schematic diagrams of merely exemplary embodiments in which.

DETAILED DESCRIPTION OF THE PRESENTLY PREFERRED EMBODIMENTS

Figure 1:
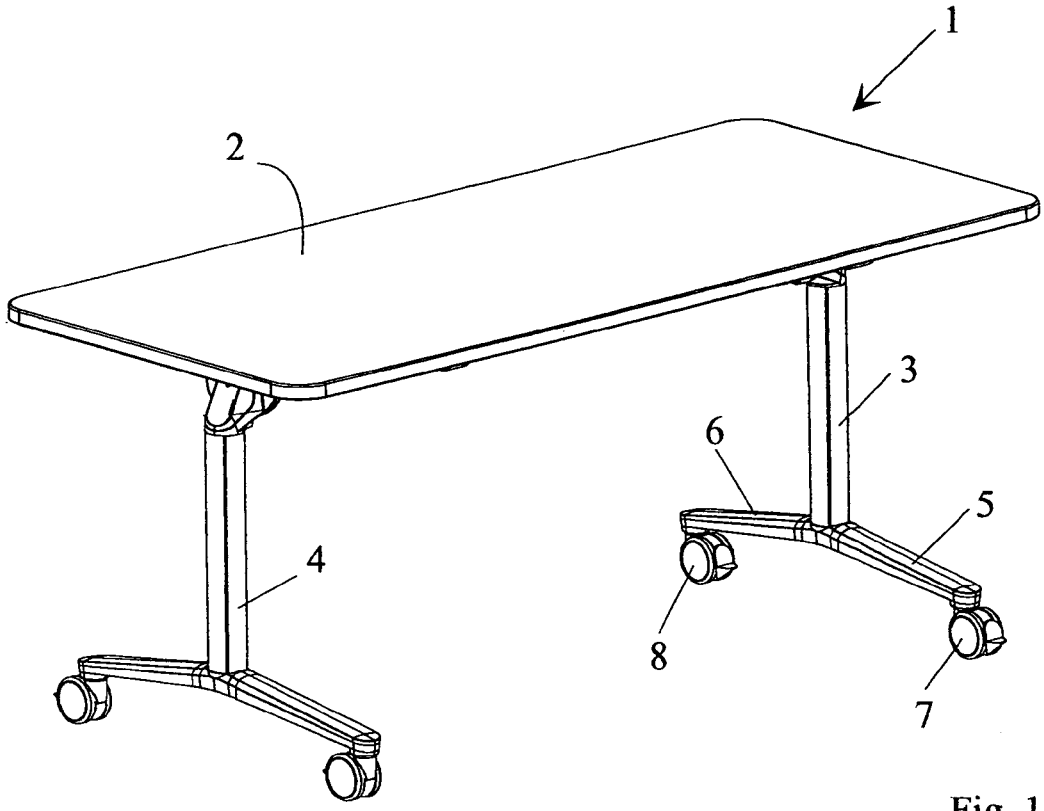
FIG. 1 shows an isometric view of a table.
Figure 2:
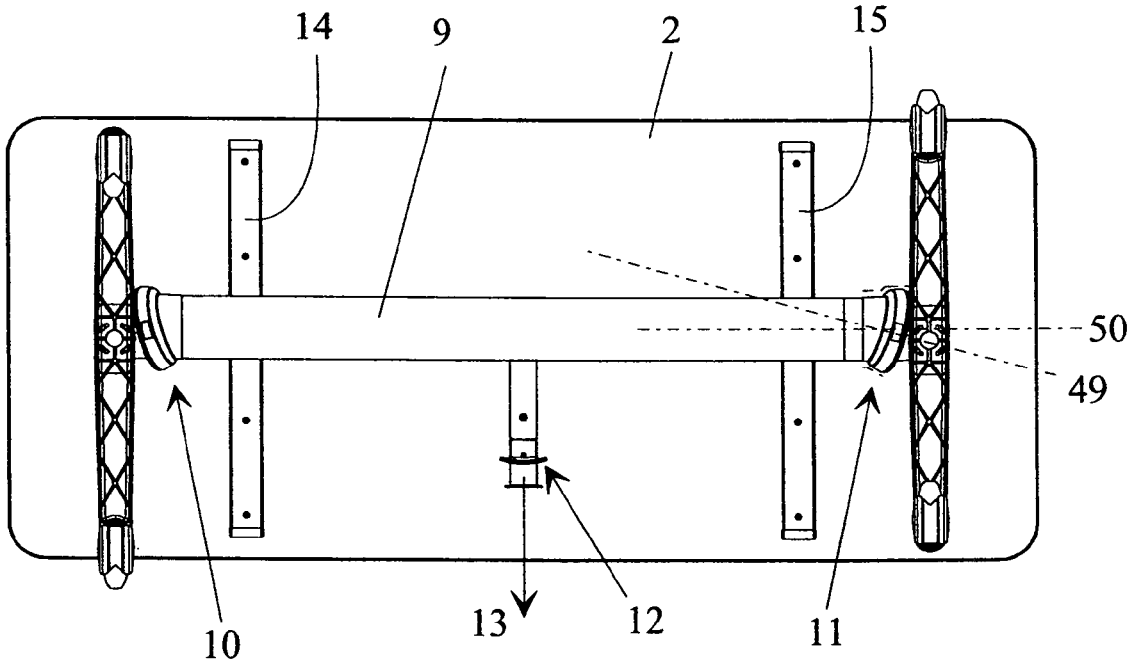
FIG. 2 shows the table according to FIG. 1 from below.

FIGS. 1 and 2 show a first exemplary embodiment of a table 1 according to the invention. The top 2 rests on two centrally located table legs 3, 4, preferably located in the middle, each of which has two splayed-out base parts 5, 6. In this exemplary embodiment, two lockable rollers 7, 8 are provided under the base parts 5, 6, so that the table 1 can also be easily moved from place to place.

Figure 5:
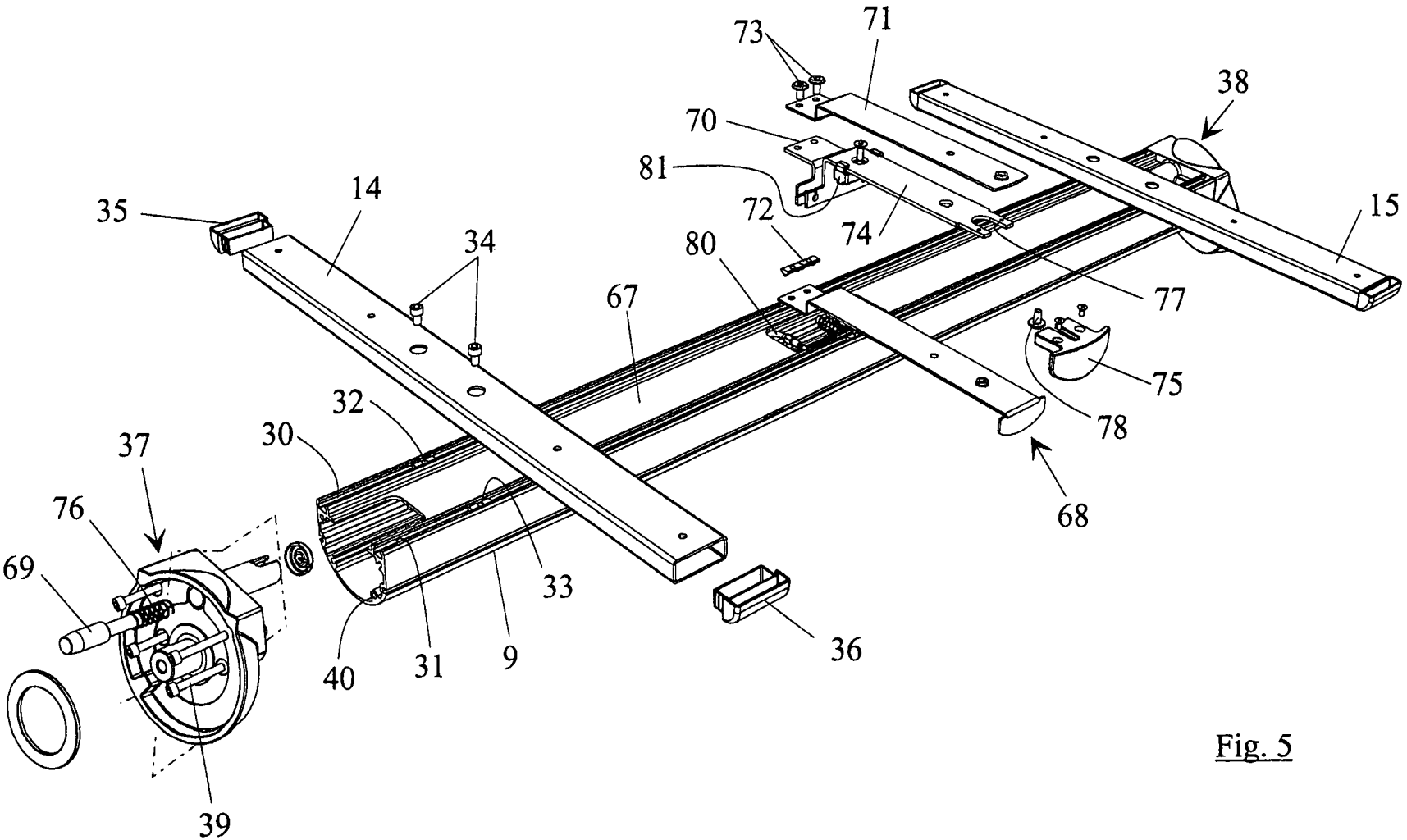
FIG. 5 shows an exploded view of a trough.
Figure 6:
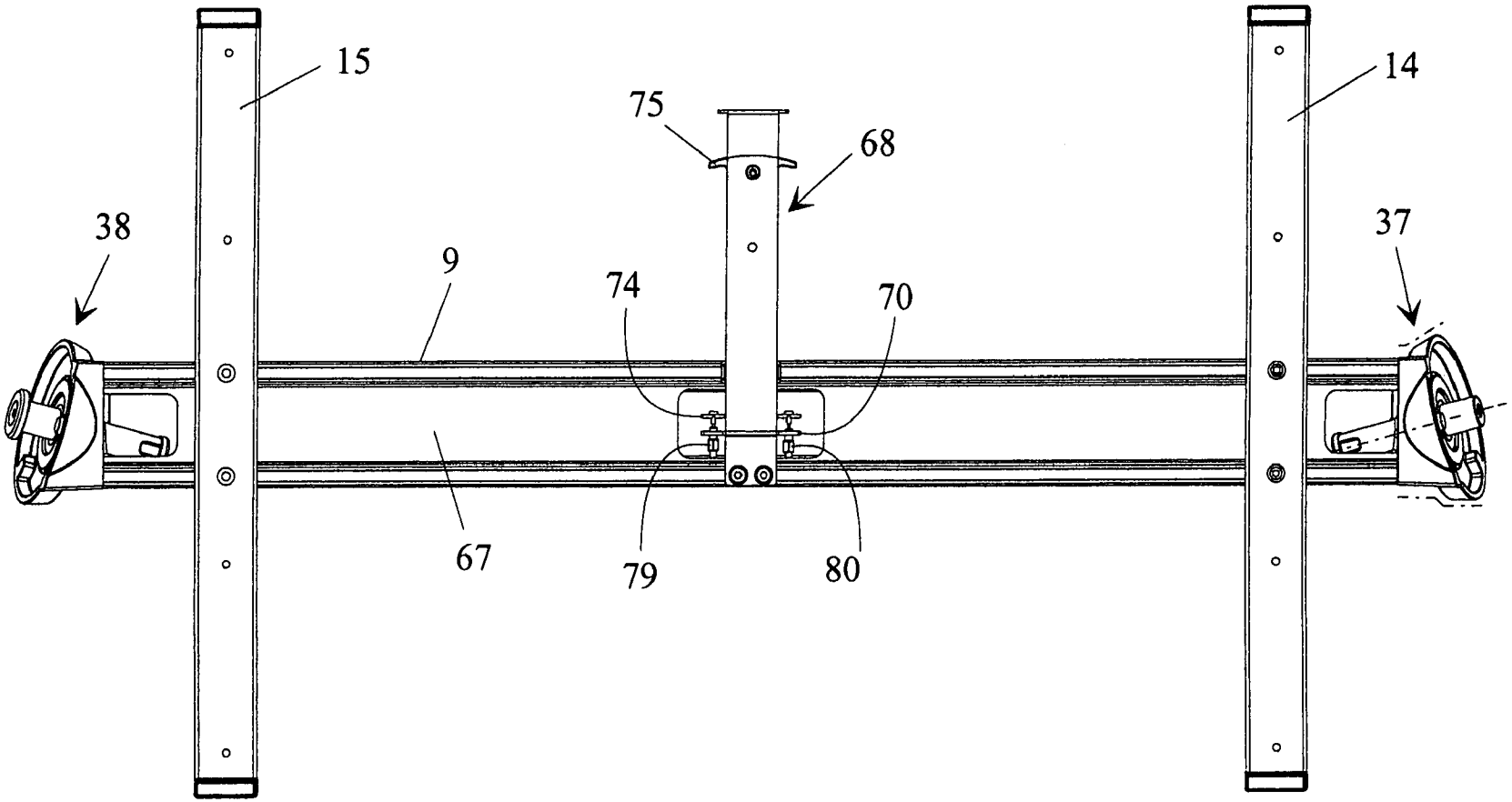
FIG. 6 shows the trough according to FIG. 5 from above, after removal of the table top.
Figure 7:
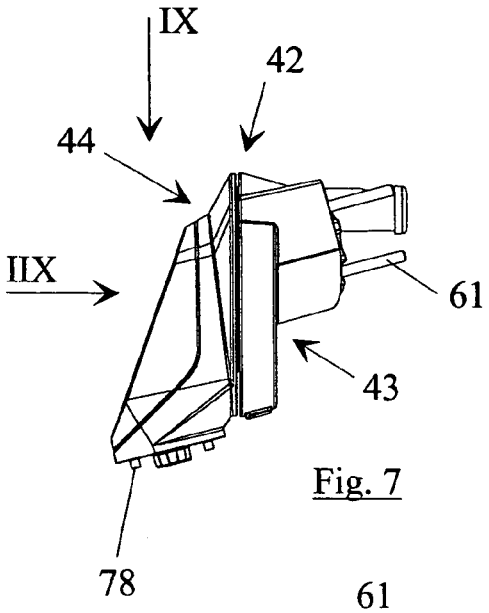
FIG. 7 shows a side view of a mounting assembly.
Figure 8:
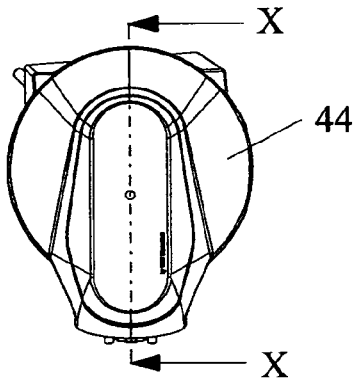
FIG. 8 shows a view of the mounting assembly in the direction of arrow IIX in FIG. 7.
Figure 9:
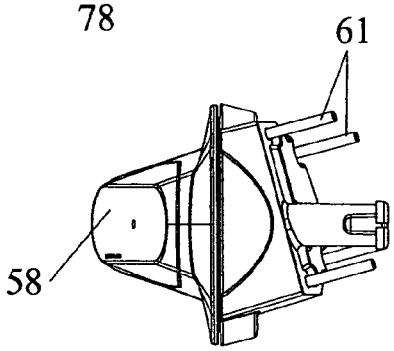
FIG. 9 shows a view in the direction of arrow IX in FIG. 7.

The table legs 3, 4 are connected to each other by a trough 9, the interior of which is accessible from above after the top 2 has been removed (see also FIGS. 5 and 6).

Figure 4:
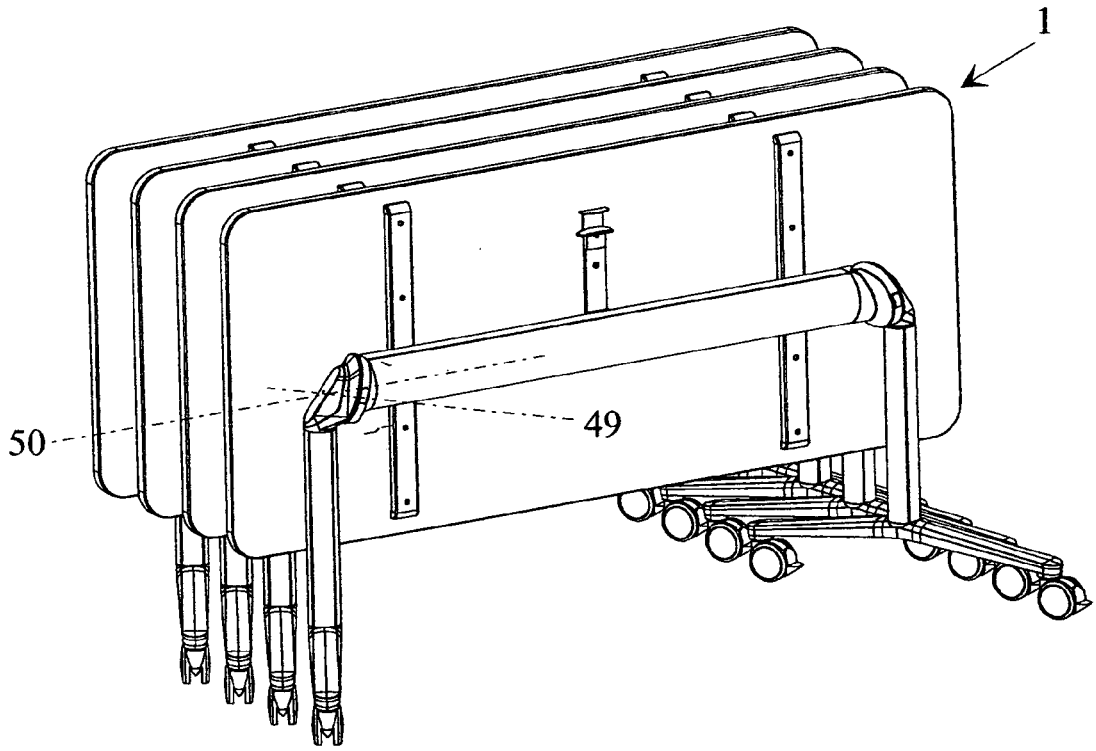
FIG. 4 shows the space-saving storage of several tables according to FIG. 1.

The trough 9 is attached to the legs 3, 4 by means of two mounting assemblies 10, 11, which allow the top 2 to be pivoted into a vertical position and the legs 3, 4 to be rotated around their vertical axis, which means that the splayed-out base parts 5, 6 will also be pivoted, so that, as shown in FIG. 4, several tables can be stored compactly with their bases nested together.

The table top 2 can be locked in various positions. It is locked positively in the mounting assemblies 10, 11. So that the table 1 can be managed easily, a force-transmitting device is provided inside the trough 9. A handle 12 is attached to this device. By actuating the handle 12, i.e., by pulling in the direction of the arrow 13, and thus by pulling on the force-transmitting device against the force of at least one spring, the top is unlocked and can then be pivoted.

When the handle 12 is released, it returns to its starting position under the force of the spring, and the table top 2 is locked again automatically. If desired, it can be locked at any desired point, but it is preferable to lock it in one of a only a few selected, preferred positions.

FIG. 2 shows that the top 2 is not supported by the trough 9 alone; instead, the top 2 is also supported by two crossbars 14, 15, which are attached to the trough, and which provide the top 2 with very sturdy support.

Figure 3:
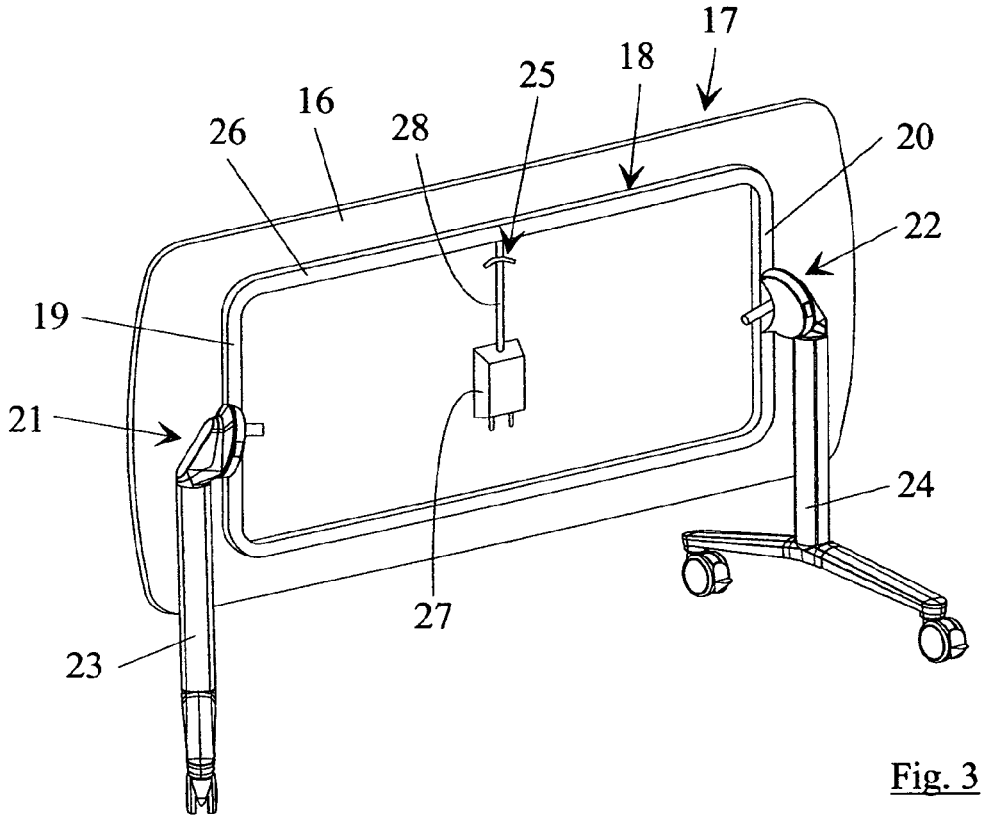
FIG. 3 shows a second exemplary embodiment of a table with folded-away top.

FIG. 3 shows an alternative method for supporting a table top 16 of a table 17, namely, by means of a peripheral frame 18. The two legs 23, 24 are connected to the frame parts 19, 20, which are transverse to the long axis of the top, by the mounting assemblies 21, 22. The connection is designed so that the legs can pivot around an axis which is oriented at a certain angle.

A handle 25 is provided to release the locking mechanism which holds the table top 16 in position, especially in a predefined position. By actuating the handle, i.e., by pulling toward the longitudinally oriented frame part 26 at the top in FIG. 3 and against the force of at least one spring, a force-transmitting device, installed in the frame part 26 and in the upper halves of the frame parts 19, 20 releases the locking function in the mounting assemblies 21, 21.

The force-transmitting device can be a mechanical linkage, but it is preferable to use a Bowden cable, which, as also in the exemplary embodiment according to FIG. 3 can easily follow the curves inside the adjacent frame sections 19, 20, 26.

Because a Bowden cable can usually transmit only tensile force, it is possible, if desired, to orient the actuating direction of the handle 25 in a favorable manner by deflecting the force direction another time, for example, underneath a cover 27, so that, by means of a linkage 28, the force required to release the locking mechanism can be easily applied by pulling toward the upper frame part 26.

FIG. 5 shows a preferred embodiment of a trough 9. This is provided on top with two undercut grooves 30, 31, in which T-blocks 32, 33 are held with freedom to slide. Thus, the crossbars 14, 15 can be easily attached by means of screws 34. In particular, the crossbars 14, 15, and possibly additional crossbars, can be attached at any point along the entire length of the trough 9.

End plugs 35, 36 close off the rectangular profile of the bar 14 in the known manner.

The trough 9 is closed off at the axial ends by the two mounting half-units 37, 38, which are attached by screws 39 to corresponding, axially oriented threaded bores 40 in the trough 9.

Figure 10:
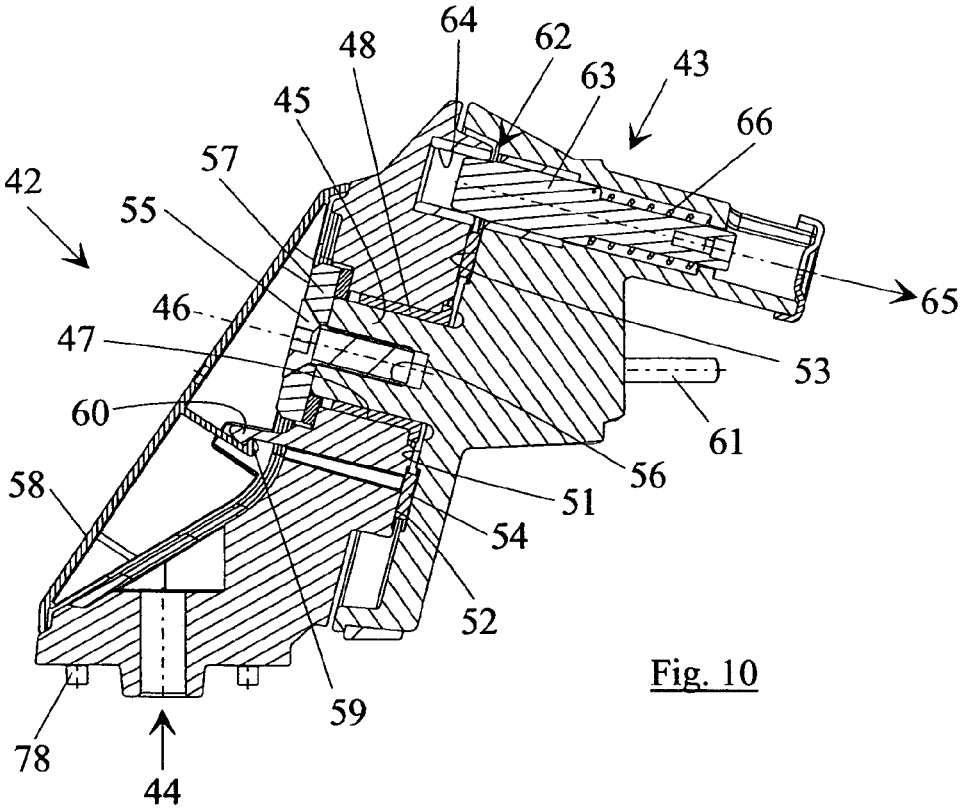
FIG. 10 shows a cross section along line X-X in FIG. 8.
Figure 11:
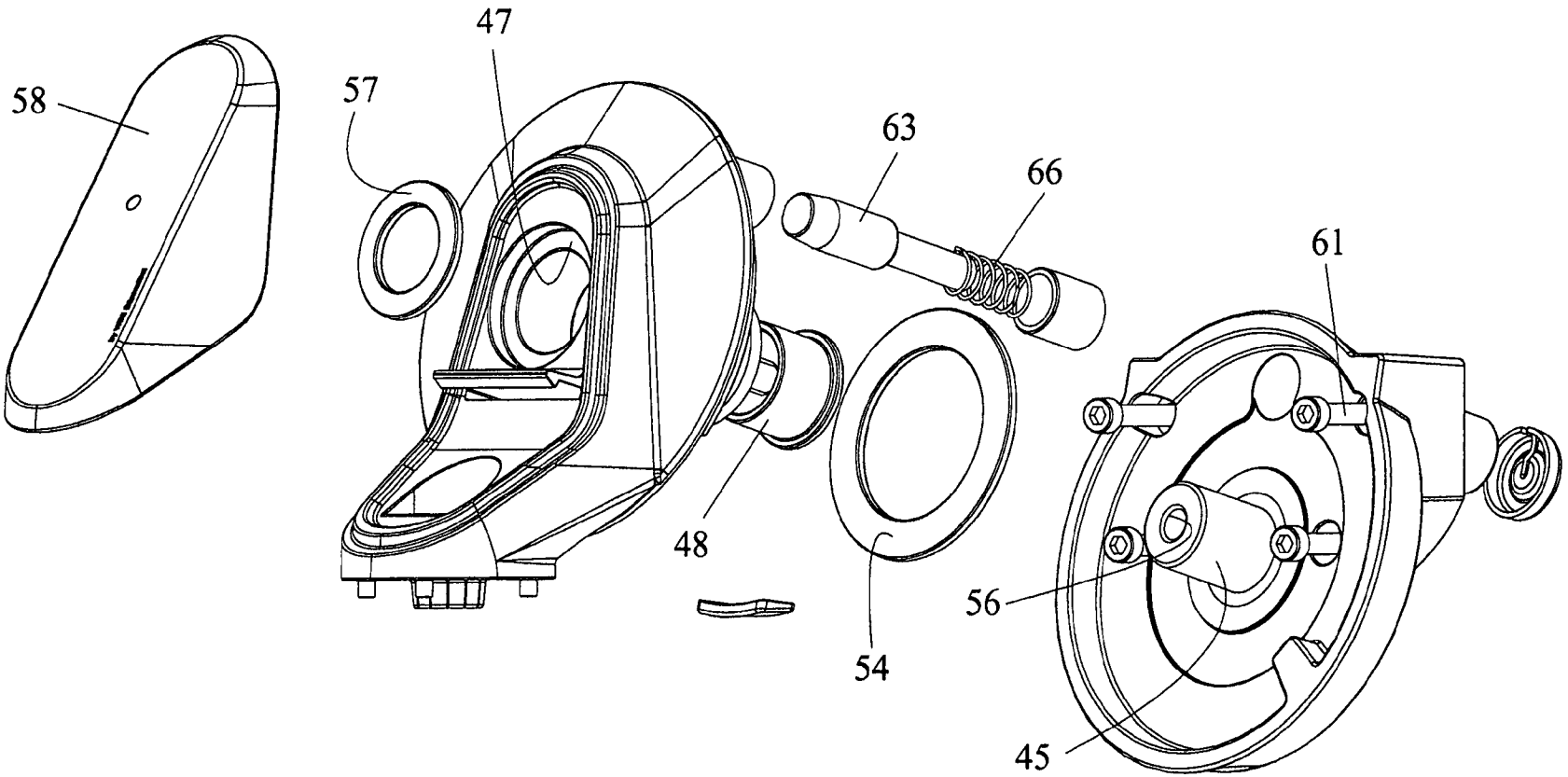
FIG. 11 shows an exploded view of the mounting assembly.

The design of a mounting assembly 42 will now be explained in greater detail on the basis of FIGS. 7-11. As the cross section in FIG. 10 shows with particular clarity, a mounting assembly 42 consists of a half-unit 43 permanently attached to the trough and a half-unit 44 permanently attached to the table leg. The half-unit 43 on the trough carries a projecting axle pin 45, the axis 46 of which is at an angle in space. As a result of this measure, when the table top is pivoted, the trough shifts toward the center of the table. In addition, the legs are rotated around their vertical axes, and the splayed-out base parts are turned toward each other at one end and away from each other at the other end.

Because the axis 46 is at an angle, the axis of rotation 49 is offset in two planes from the center line 50 of the table top 2 and/or of the trough 9 (see FIGS. 2 and 4).

The axle pin 45 is held in a receptacle 47 in the half-unit 44 on the leg and rotates around its axis 46 in a sleeve 48, which is a separate part, inserted into the receptacle 47.

The two half-units 43, 44 of the mounting assembly also have opposing, parallel surfaces 51, 52. The axis 46 is perpendicular to these surfaces, and thus the axle pin 45 and receptacle 47 are perpendicular to them as well.

A ring-shaped, circumferential groove 53 is introduced into the surface 51 of the half-unit 43 on the trough. A slide ring 54, on which the two surfaces 51 and 52 slide during rotation, is inserted into this groove.

The two half-units 43, 44 of the mounting assembly are connected to each other by a screw 55, which is permanently connected to the trough by engaging in a central threaded bore 56 in the axle pin 45, thus holding in place an opposing mounting plate 57 of the second half-unit 44, permanently connected to the leg.

This connection between the two half-units 43, 44 is covered by a cap 58, which is held in place, preferably in a detachable manner, by interlocking projections 59, 60.

In a manner comparable to the fixation of the half-unit 43 to the trough by means of screws 61, the second half-unit 44 is attached to the table leg by screws 78.

In this exemplary embodiment, the axis 46 and thus also the table top are locked in place positively, this positive connection being produced by a locking pin 63, permanently attached to the trough. The pin engages with a locking action in various receptacles 64, which correspond to the preferred positions. This locking function 62 can be released by pulling the locking pin 63 out in the direction of arrow 65 against the force of a spring 66, which returns the locking pin 63 into the locking position.

The locking function 62 is released by way of a force-transmitting device, which is installed in the trough 9.

FIGS. 5 and 6 show, under a cover 67, two Bowden cables 79, 80, serving as a force-transmitting device between a handle 68 and a locking pin 69 of the half-unit 37 and a locking pin of the half-unit 38, so that the releasing and pivoting actions can proceed in synchronized fashion.

In this exemplary embodiment, the Bowden cables 79, 80 are located more-or-less in the middle of the trough 9 and are fastened at the ends to an angle bracket 70, which, together with a support bracket 71, is fastened by means of screws 73 to a T-block 72 held in the groove 30. As a result, the handle 68, can be positioned at any desired point along the length of the trough 9, as long as the Bowden cables 79, 80 are laid out suitably.

The cores of the Bowden cables 79, 80 can be pulled out by means of an additional angle piece 74 and a handle 75 attached to the angle piece 74. Thus the locking pin 69 can be pulled out of its locking position against the force of the spring 76. The same is also true for the second mounting assembly, i.e., for the second half-unit 38.

A screw 78, which passes through a slot 77 and is screwed to the support bracket 71, guides the angle piece 74 as it is being pulled out and holds it against the support bracket 71. The path of the pull-out movement is also limited by a stop 81, attached to the angle piece 74, so that the Bowden cables 79, 80 cannot be pulled out too far.

The invention is not limited by the embodiments described above which are presented as examples only but can be modified in various ways within the scope of protection defined by the appended claims.

I claim:

1. A table with a top which can pivot around a lockable pivot axis, comprising:

two centrally located table legs positioned substantially along a longitudinal centerline of the table, each having a top end;

each of the two centrally located table legs is connected at the top end by a mounting assembly to a frame part, which carries the table top, each mounting assembly including a first half unit connected to the respective frame part, the first half unit having a freely projecting axle pin, and a second half-unit connected to the top end of each of the two table legs, the second half-unit having a receptacle to rotatably accommodate a respective one of the axle pins, the projecting axle pin of each said first half-unit having an axis extending at an oblique angle relative to each other and to the centerline of the table, the axis being offset from a first horizontal plane of the table top and a second plane normal to the first plane.

2. The table according to claim 1, characterized in that wherein the frame parts are parts of a frame designed to connect the table legs to each other.

3. The table according to claim 2, wherein the frame parts are parts of a frame designed to extend around a periphery of the table top.

4. The table according to claim 2, wherein the frame is designed as a central trough, which supports the table top.

5. The table according to claim 1, wherein the lockable pivot axis is one of the axle pin axes, the table further comprising:

a force-transmitting device provided in at least one of the frame parts; and a handle connected to the force-transmitting device, wherein the pivot axis can be released by actuating the handle against the force of at least one spring to allow the table top to pivot.

6. The table according to claim 5, wherein, after the handle is released, the pivot axis is locked automatically in predefined, preferred positions through the force of the minimum of one spring such that a positive locking function is provided.

7. The table according to claim 5, wherein at least one locking pin is permanently mounted in the frame, which can be pulled out of a receptacle permanently installed in a leg by means of the force-transmitting device.

8. The table according to claim 7, wherein the pull-out direction of the locking pin is parallel to an axis.

9. The table according to claim 5, wherein the force-transmitting device is a Bowden cable.

10. The table according to claim 9, wherein the Bowden cable passes around the handle, and in that the handle is supported so that it can be shifted and/or pivoted.

11. The table according to claim 5, wherein the frame is designed as a central trough, which supports the table top, and the force-transmitting device is provided in the trough, the handle can be positioned at various points along the length of a frame part or of the trough.

12. The table according to claim 1, wherein the axle pin is rotatably supported in a separately provided sleeve.

13. The table according to claim 1, wherein the two half-units of each said mounting assembly have opposing parallel surfaces, to which the axle pin and its receptacle are perpendicular.

14. The table according to claim 13, wherein at least one locking pin is permanently mounted in one of the frame part or one leg of the table legs, which can be pulled out of a receptacle permanently installed in the other of the frame part or the one leg by a force-transmitting device, and the pull-out direction of the locking pin is perpendicular to the surfaces.

15. The table according to claim 13, wherein at least one of the opposing surfaces has a ring-shaped, circumferential groove to accept a slide ring.

16. The table according to claim 1, wherein the axle pin has a central threaded bore for the fastening of an opposing mounting plate permanently attached to a table leg.

17. The table according to claim 1, wherein the axle pin is covered by a cap, which is mounted detachably on the second half unit of the mounting assembly.

18. The table according to claim 4, wherein the table top rests on crossbars permanently connected to the trough.

19. The table according to claim 18, wherein the crossbars can be freely positioned at any point along the length of the trough.

* * * * *